US007157844B2

(12) United States Patent
Asano et al.

(10) Patent No.: US 7,157,844 B2
(45) Date of Patent: Jan. 2, 2007

(54) CATHODE RAY TUBE PROVIDED WITH A FACEPLATE HAVING A CONVEX OUTER SURFACE AND A LENS ASSEMBLY ATTACHED THEREIN

(75) Inventors: Tetsuo Asano, Mobara (JP); Kenji Kato, Mobara (JP)

(73) Assignee: Hitachi Displays, Ltd., Chiba-Ken (JP)

( * ) Notice: Subject to any disclaimer, the term of this patent is extended or adjusted under 35 U.S.C. 154(b) by 75 days.

(21) Appl. No.: 10/836,519

(22) Filed: Apr. 29, 2004

(65) Prior Publication Data

US 2004/0217686 A1 Nov. 4, 2004

(30) Foreign Application Priority Data

May 2, 2003 (JP) ..... 2003-127353

(51) Int. Cl.
*H01J 29/89* (2006.01)
*H01J 29/86* (2006.01)

(52) U.S. Cl. ..... 313/478; 313/35; 313/36; 313/17; 313/110; 313/111; 313/112; 313/477 R; 359/649; 348/781; 348/785; 348/832

(58) Field of Classification Search ..... 313/478, 313/35, 36; 348/781, 785, 832; 359/649
See application file for complete search history.

(56) References Cited

U.S. PATENT DOCUMENTS

| | | | | |
|---|---|---|---|---|
| 4,804,884 | A * | 2/1989 | Vriens et al. | 313/478 |
| 4,899,080 | A * | 2/1990 | Vriens et al. | 313/477 R |
| 2003/0034727 | A1 * | 2/2003 | Okada et al. | 313/478 |
| 2004/0217686 | A1 * | 11/2004 | Asano et al. | 313/477 R |

FOREIGN PATENT DOCUMENTS

| | | | |
|---|---|---|---|
| JP | 61068841 | A * | 4/1986 |
| JP | 62090822 | A * | 4/1987 |
| JP | 63195931 | A * | 8/1988 |

* cited by examiner

*Primary Examiner*—Mariceli Santiago
(74) *Attorney, Agent, or Firm*—Milbank, Tweed, Hadley & McCloy, LLP

(57) ABSTRACT

In a projection cathode ray tube device in which a projection cathode ray tube and a projection lens assembly are coupled and held by a coupler, superior focus characteristics and high resolution are realized by eliminating the deviation between the center of the phosphor screen of the cathode ray tube and the center of the lens assembly. In the cathode ray tube, each of the outside and inside surfaces of a faceplate is formed as a spherical convex surface which is curved toward an electron gun.

9 Claims, 7 Drawing Sheets

CATHODE RAY TUBE PROVIDED WITH A FACEPLATE HAVING A CONVEX OUTER SURFACE AND A LENS ASSEMBLY ATTACHED THEREIN

CROSS-REFERENCE TO RELATED APPLICATION

The present application claims priority from Japanese application JP2003-127353 filed on May 2, 2003, the content of which is hereby incorporated by reference into this application

BACKGROUND OF THE INVENTION

1. Field of the Invention

The present invention relates to a cathode ray tube device including a projection cathode ray tube having an electron gun for emitting a single electron beam toward a phosphor screen and, more particularly, to a cathode ray tube device constructed to prevent the deviation between the center of the phosphor screen of a projection cathode ray tube and the center of a projection lens as well as to an image display apparatus using the cathode ray tube device.

2. Description of the Related Art

In general, a projection color image display apparatus such as a projection color TV set employs three projection cathode ray tube devices for respectively reproducing images of primary colors, i.e., red, green and blue, and projects three primary color images obtained from these three projection cathode ray tube devices onto a screen by using an optical lens or a mirror on an enlarged scale and superposes the three primary color images to form a color image on the screen. Incidentally, there are projection cathode ray tubes having phosphor screens having diagonal sizes of 5.5 inches, 7 inches and the like, and projection TV sets employ screens having diagonal sizes of approximately 40–70 inches.

FIG. 11 is a schematic cross-sectional view aiding in describing an example of the construction of a related-art projection cathode ray tube device which is used in a projection color image display apparatus such as the above-mentioned projection color television set. In FIG. 11, reference numeral 1 denotes a panel portion, reference numeral 2 denotes a funnel portion, reference numeral 3 denotes a neck portion, and reference numeral 4 denotes a stem portion, and the panel portion 1, the funnel portion 2, the neck portion 3 and the stem portion 4 constitute an evacuated envelope 5. Reference numeral 6 denotes an electron gun, and this electron gun 6 is disposed in the neck portion 3. The panel portion 1 has a faceplate 11 and a sidewall 12 which extends toward the funnel portion 2, and the faceplate 11 is provided with a phosphor screen 11*b* on an inside surface 11*a*, and light emitted from the phosphor screen 11*b* is radiated outwardly from an outside surface 11*c*.

The inside surface 11*a* of the faceplate 11 has a spherical form having the center of curvature on the side of the outside surface 11*c*, and its convex surface is disposed on the side of the electron gun 6. The outside surface 11*c* is flat. The electron gun 6 has a plurality of electrodes, and emits a single electron beam toward the phosphor screen 11*b* to excite phosphors to cause them to emit light. In FIG. 11, reference numeral 13 generally denotes a cathode ray tube.

Reference numeral 14 denotes a deflector which includes a deflection yoke, a convergence yoke and the like. The deflector 14 is fitted on a transition portion between the neck portion 3 and the funnel portion 2 of the cathode ray tube 13, and the electron beam emitted from the electron gun 6 is deflected in the x direction (the horizontal direction) and they direction (the vertical direction) by the deflection yoke of the deflector 14 and is made to impinge on the phosphor screen 11*b* formed on the inside surface 11*a* of the faceplate 11 of the panel portion 1, thereby forming a required image.

Reference numeral 15 denotes a lens assembly, and this lens assembly 15 is disposed in opposition to the outside surface 11*c* of the faceplate 11 and is constructed to project an image on the phosphor screen 11*b* on a screen (not shown) on an enlarged scale. The lens assembly 15 is coupled to the cathode ray tube 13 via a coupler 16. This coupling is carried out after the completion of alignment of the central axis of the lens assembly 15 and the center of the phosphor screen 11*b* formed on the inside surface 11*a* of the faceplate 11.

It is to be noted that the coupling of the cathode ray tube 13 and the coupler 16 in this coupling structure can adopt, for example, means using an engagement unit disclosed in Patent Document 1.

Reference numeral 17 denotes a refrigerant liquid, and this refrigerant liquid 17 has the function of coming into contact with and cooling the outside surface 11*c* of the faceplate 11 of the panel portion 1. This refrigerant liquid 17 is held in a space which is surrounded by the coupler 16, the lens assembly 15 and the outside surface 11*c* of the faceplate 11.

Reference numeral 18 generally denotes a cathode ray tube device.

As one related art associated with the faceplate of this kind of projection cathode ray tube device, Patent Document 2 discloses a construction in which the obverse side of the front wall of a bulb is formed as a concave surface and the inside surface of the same is formed as a convex surface.

As another related art associated with a lens system which projects an image of the surface of a concave object onto a flat display screen, Patent Document 3 discloses a content including a construction in which a faceplate is formed to have a construction similar to that disclosed in Patent Document 2.

As yet another related art associated with an image projecting system provided with a multi-element projection lens system, Patent Document 4 discloses a construction in which a faceplate is formed to have a construction similar to that disclosed in Patent Document 2 and a plate-shaped holding unit through which to pass a coolant is disposed between the faceplate and a lens.

Patent Document 5 discloses the illustration of a faceplate formed to have a construction similar to that disclosed in Patent Document 2.

Patent Document 1 is JP-A-62-8423.
Patent Document 2 is JP-A-58-44657.
Patent Document 3 is JP-A-60-43627.
Patent Document 4 is JP-A-63-148221.
Patent Document 5 is UK Patent No. 2,091,898.

SUMMARY OF THE INVENTION

Projection cathode ray tube devices generally have a construction in which a cathode ray tube and a lens assembly of a projection optical system are integrally coupled by a coupler with the center of the phosphor screen of the cathode ray tube coinciding with the center of the lens assembly. In this construction, the lens assembly can be worked by machining or the like and can be secured to the coupler with high precision. However, when the cathode ray tube is to be secured to the coupler, a positioning jig is employed, and other means is also employed; for example, an external reference of a panel portion or a portion of the external form of the same is used as a positioning point. However, since deviation or the like occurs in the position of the jig, it is difficult to correctly secure the phosphor screen to the coupler.

To ensure focus performance, particularly, peripheral focus performance, it is necessary to make the center of the lens assembly accurately coincident with the center of the phosphor screen, but any of the related arts encounters the disadvantage that the deviation of both centers is difficult to eliminate and there is a need to discover solutions for improving the uniformity of focus over all regions of the phosphor screen.

For example, if an axial deviation of 0.5 mm occurs, the phosphor screen suffers a positional deviation of ±0.1 mm in each corner of a 5-inch raster (at a point 64 mm distant from the panel center), so that a deviation of 0.2 mm occurs in each of opposite diagonal corners to degrade peripheral focus performance.

The above-mentioned problem of peripheral focus performance remarkably appears in an image display apparatus using such a cathode ray tube device because the image display apparatus projects an enlarged image on the screen. Accordingly, there has been a demand for a rapid solution to the problem of peripheral focus performance.

On the other hand, the above-mentioned problem is not posed in any of Patent Documents 1 to 5, and has not yet been solved in any related art including Patent Documents 1 to 5.

The invention, therefore, solves the above-mentioned problem and provides a projection cathode ray tube device which has good uniformity of focus over all regions of the phosphor screen and is superior in resolution.

The invention provides a cathode ray tube device in which each of the outside and inside surfaces of a faceplate of a cathode ray tube is formed as a convex surface curved toward an electron gun and the curvature of the outside surface of the faceplate is made smaller than the curvature of the inside surface to eliminate focus degradation and achieve superior resolution. The invention also provides an image display apparatus using the cathode ray tube device. Representative constructions of the invention will be described below.

A cathode ray tube device according to the invention includes: a cathode ray tube including a panel portion having an image-displaying phosphor screen on an inside surface of a faceplate, a neck portion containing an electron gun to emit an electron beam toward the phosphor screen, a funnel portion connecting the panel portion and the neck portion, and a stem portion closing an open end of the neck portion; a deflector containing a deflection yoke fitted on the cathode ray tube; a lens assembly disposed on the side of an outside surface of the faceplate; a coupler disposed between the lens assembly and the cathode ray tube to couple both of them to each other, and provided with a flange portion facing the outside surface of the faceplate; and a refrigerant liquid disposed in a space surrounded by the lens assembly, the coupler and the outside surface of the faceplate, and approximately the whole region of each of the inside and outside surfaces of the faceplate is a convex surface curved toward the electron gun and an outside-surface curvature of the faceplate is smaller than an inside-surface curvature of the faceplate.

In the cathode ray tube device according to the invention, the center of curvature of each of the inside and outside surfaces of the faceplate is located at the same point on a side where the lens assembly is disposed. In addition, the faceplate can be given a uniform thickness in approximately all regions, and the inside surface of the faceplate can be made aspherical.

Furthermore, the flange portion of the coupler can be formed as a convex surface curved toward the electron gun, and the convex surface of the flange portion of the coupler can be made approximately the same in curvature as the outside surface of the faceplate, and a lens surface of the lens assembly that is in contact with the refrigerant liquid can be formed as a convex surface curved toward the electron gun.

Furthermore, the outside surface of the faceplate can be given a single radius of curvature, and the surface of the coupler that is in contact with the faceplate is formed to have a radius of curvature which is the same as the curvature of the outside surface of the faceplate. The coupler is fixed to the faceplate by being pressed against the faceplate by a fixing member, and screws which constitute this fixing member are symmetrically disposed with respect to a tube axis of the cathode ray tube, and these screws can be tightened to generate tightening forces in a direction parallel to the tube axis.

An image display apparatus according to the invention includes three cathode ray tube devices arrayed in line in a horizontal direction and operative to display red, blue and green images, respectively, and is constructed to project images displayed on the three cathode ray tube devices on a screen on an enlarged scale. Each of the cathode ray tube devices includes: a cathode ray tube; a lens assembly disposed on a front side of a faceplate of the cathode ray tube; a coupler coupling the lens assembly and the cathode ray tube; a refrigerant liquid disposed in contact with the front side of the faceplate of the cathode ray tube; and a deflector fitted on the cathode ray tube. Approximately the whole region of each of inside and outside surfaces of the faceplate of the cathode ray tube is a convex surface curved toward an electron gun, and an outside-surface curvature of the faceplate is smaller than an inside-surface curvature of the faceplate.

In the image display apparatus according to the invention, the center of curvature of each of the inside and outside surfaces of the faceplate is located at the same point on a side where the lens assembly is disposed. In addition, the faceplate can be given a uniform thickness in approximately all regions, and the inside surface of the faceplate can be made aspherical.

Furthermore, in the image display apparatus according to the invention, the flange portion of the coupler can be formed as a convex surface curved toward the electron gun, and the convex surface of the flange portion of the coupler can be made approximately the same in curvature as the outside surface of the faceplate, and a lens surface of the lens assembly that is in contact with the refrigerant liquid can be formed as a convex surface curved toward the electron gun. Furthermore, the outside surface of the faceplate can be given a single radius of curvature, and the surface of the coupler that is in contact with the faceplate is formed to have a radius of curvature which is the same as the curvature of the outside surface of the faceplate. The coupler is fixed to the faceplate by being pressed against the faceplate by a fixing member, and screws which constitute this fixing member are symmetrically disposed with respect to a tube axis of the cathode ray tube, and these screws can be tightened to generate tightening forces in a direction parallel to the tube axis.

According to the above-described construction, it is possible to easily make the tube axis of the cathode ray tube coincident with the central axis of the coupler and improve the uniformity of focus over all regions of a phosphor screen, whereby it is possible to provide a cathode ray tube device having superior resolution as well as an image display apparatus using the same.

It goes without saying that the invention is not limited to any of the above-mentioned constructions nor to any of the constructions of embodiments which will be described later, and various modifications can be made without departing from the technical idea of the invention.

DETAILED DESCRIPTION OF THE INVENTION

Preferred embodiments of the invention will be described below in detail with reference to drawings which show the respective embodiments.

Figure 1:
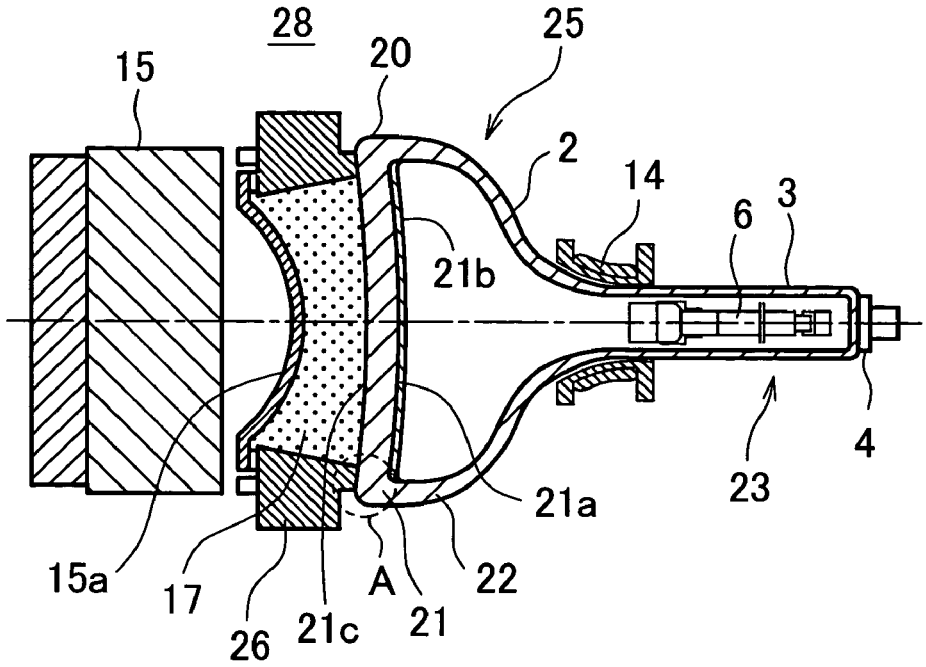
FIG. 1 is a schematic cross-sectional view showing one embodiment of a projection cathode ray tube device according to the invention.
Figure 2:
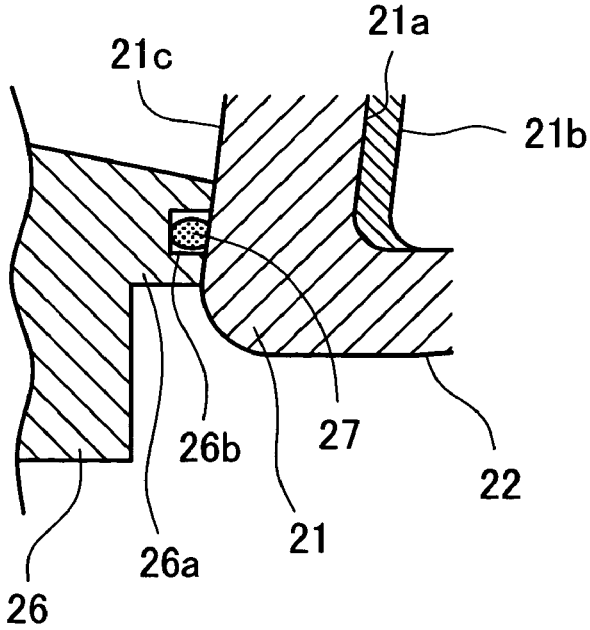
FIG. 2 is an enlarged view of a portion A of FIG. 1.

FIG. 1 is a schematic cross-sectional view showing one embodiment of a projection cathode ray tube device according to the invention, and FIG. 2 is an enlarged view of a portion A of FIG. 1. In FIGS. 1 and 2, reference numeral 20 denotes a panel portion, reference numeral 2 denotes a funnel portion, reference numeral 3 denotes a neck portion, and reference numeral 4 denotes a stem portion, and the panel portion 20, the funnel portion 2, the neck portion 3 and the stem portion 4 constitute an evacuated envelope 25. Reference numeral 6 denotes an electron gun, and this electron gun 6 is disposed in the neck portion 3.

The panel portion 20 has a faceplate 21 and a sidewall 22 which extends toward the funnel portion 2, and the faceplate 21 is provided with a phosphor screen 21*b* on an inside surface 21*a*, and light emitted from the phosphor screen 21*b* is radiated outwardly from an outside surface 21*c*.

The inside surface 21*a* of the faceplate 21 has a spherical form having the center of curvature on the side of the outside surface 21*c*, and its convex surface is disposed on the side of the electron gun 6. The outside surface 21*c* also has a spherical form having the center of curvature at the center of curvature of the inside surface 21*a*, and its convex surface is disposed on the side of the electron gun 6.

The electron gun 6 has a plurality of electrodes, and emits a single electron beam toward the phosphor screen 21*b* to excite phosphors to cause them to emit light. In FIG. 1, reference numeral 23 denotes a cathode ray tube.

Reference numeral 14 denotes a deflector which includes a deflection yoke, a convergence yoke and the like. The deflector 14 is fitted on a transition portion between the neck portion 3 and the funnel portion 2 of the cathode ray tube 23, and the electron beam emitted from the electron gun 6 is deflected in the x direction (the horizontal direction) and they direction (the vertical direction) by the deflection yoke of the deflector 14 and is made to impinge on the phosphor screen 21*b* formed on the inside surface 21*a* of the faceplate 21 of the panel portion 20, thereby forming a required image.

Reference numeral 15 denotes a lens assembly, and this lens assembly 15 is disposed in opposition to the outside surface 21*c* of the faceplate 21 and is constructed to project an image on the phosphor screen 21*b* on a screen (not shown) on an enlarged scale.

The lens assembly 15 is coupled to the cathode ray tube 23 via a coupler 26. This coupling is carried out after the completion of alignment of the central axis of the lens assembly 15 and the center of the phosphor screen 21*b* formed on the inside surface 21*a* of the faceplate 21.

A lens 15*a* of the lens assembly 15 is in contact with the refrigerant liquid 17, and is constructed to have a surface which is in contact with the refrigerant liquid 17 and has a convex form on the side of the electron gun 6. This refrigerant liquid 17 has the function of coming into contact with and cooling the outside surface 21*c* of the faceplate 21 of the panel portion 20.

The coupler 26 has a flange 26*a* which faces the periphery of the outside surface 21*c* of the faceplate 21, and the end of the flange 26*a* that is in contact with the outside surface 21*c* has a spherical form having the center of curvature on the side of the lens assembly 15, and its convex surface is disposed on the side of the electron gun 6. This flange 26*a* has an O-ring 27 disposed in a groove 26*b* at the end to provide sealing to prevent leakage of the refrigerant liquid 17. The refrigerant liquid 17 is held in a space which is surrounded by the coupler 26, the lens assembly 15 and the outside surface 21*c* of the faceplate 21. Reference numeral 28 generally denotes a cathode ray tube device. The faceplate 21 has the same thickness in approximately all regions.

Figure 3:
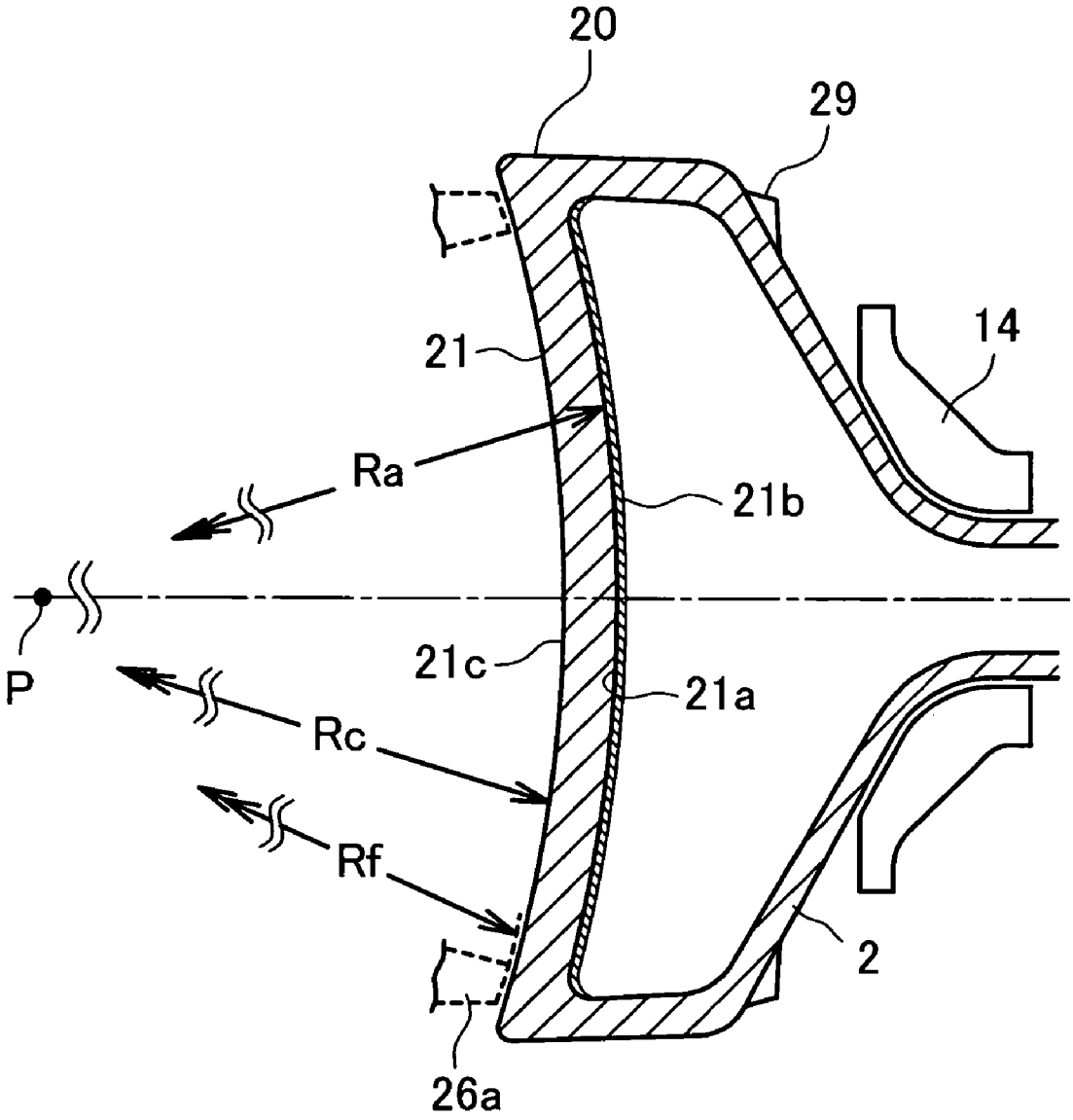
FIG. 3 is a schematic cross-sectional view showing a portion of FIG. 1 on an enlarged scale.

FIG. 3 is a schematic cross-sectional view showing a portion of FIG. 1 on an enlarged scale. In FIG. 3, the outside surface 21*c* of the faceplate 21 is formed in a spherical form having a radius of curvature Rc centered about a center of curvature P, and its convex surface is curved toward the electron gun which is not shown in FIG. 3. The inside surface 21*a* of the faceplate 21 is formed in a spherical form having a radius of curvature Ra centered about the same center of curvature P, and its convex surface is similarly curved toward the electron gun.

The end face of the flange 26*a* of the coupler 26 that is opposite to the outside surface 21*c* of the faceplate 21 is formed in a spherical form having a radius of curvature Rf centered about the center of curvature P, and its convex surface is similarly curved toward the electron gun. In FIG. 3, reference numeral 29 denotes projections provided on the outside surface of the funnel portion 2, and these projections 29 are used for purposes such as the engagement of the funnel portion 2 with the coupler 26 and positioning during the incorporation of the cathode ray tube 23 and the coupler 26. The focus of the coupler 26 and the focus of the outside surface 21*c* of the face plate only has to be corresponding. In this embodiment of cathode ray tube, to match the axis of the coupler and the axis of the cathode ray tube is unnecessary. Therefore, it becomes easy to manufacture the cathode ray tube device.

In one specific example of the cathode ray tube device according to the invention, Ra: 350 mm, Rc: 340 mm, Rf: 340 mm, and faceplate thickness: 10 mm.

In the construction of the above-mentioned embodiment, since the phosphor screen can be positively disposed at the desired position, the desired focus performance can be ensured in approximately all regions of the phosphor screen including the periphery thereof, and the thickness of the refrigerant liquid becomes uniform and the temperature dependence of the optical system is reduced, whereby focus drift in an image display apparatus can be decreased.

Figure 4:
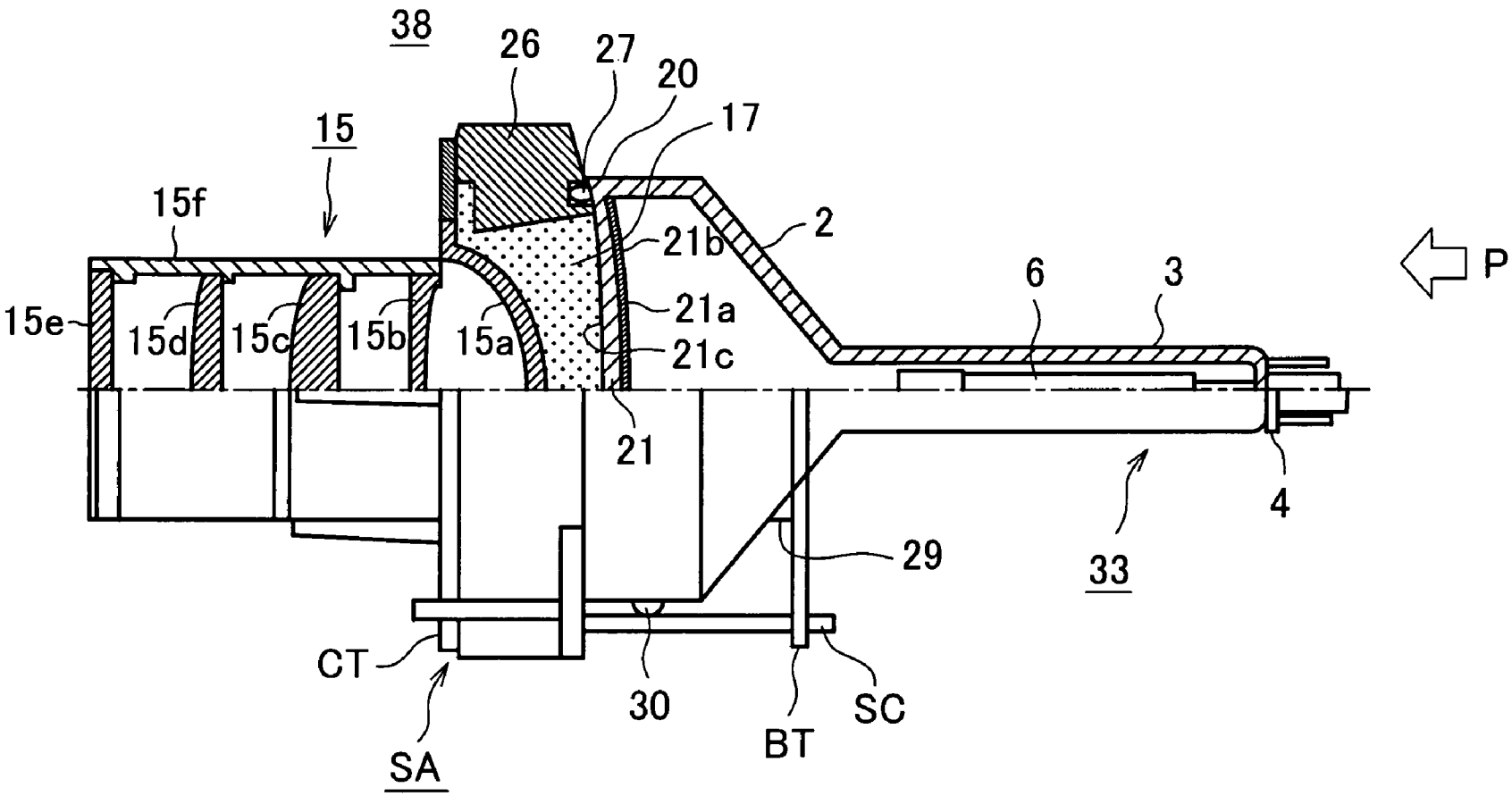
FIG. 4 is a schematic side view showing another embodiment of the cathode ray tube device according to the invention.
Figure 5:
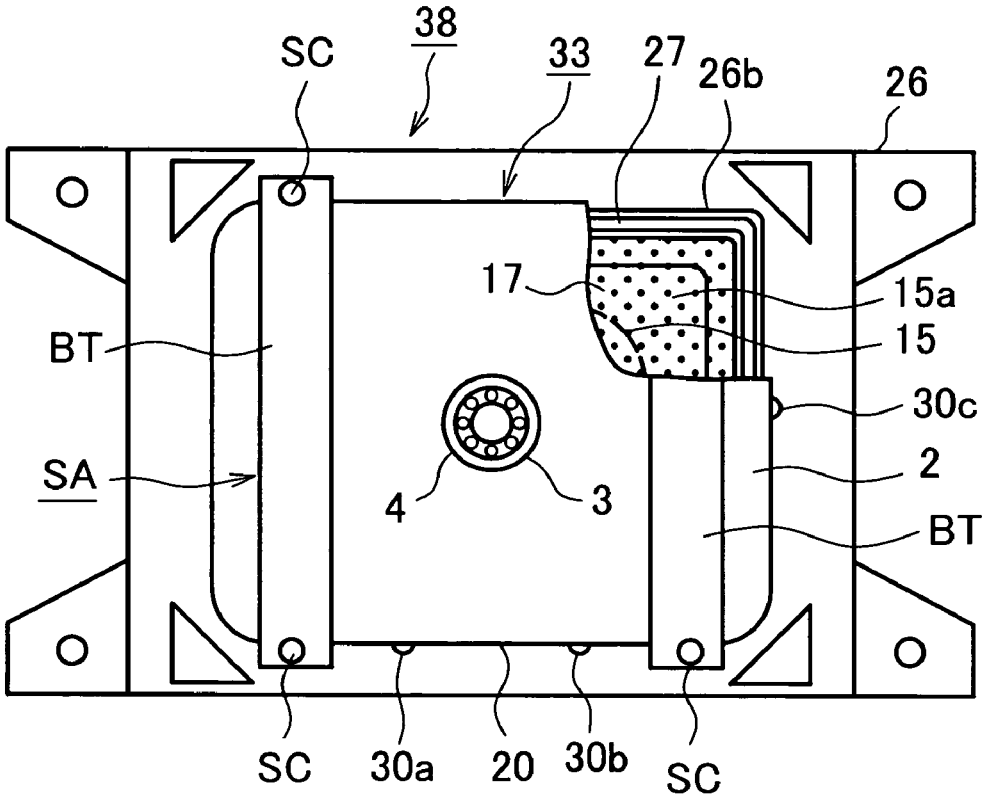
FIG. 5 is a partially cut-away rear view seen in the P direction in FIG. 4.

FIG. 4 is a schematic side view showing another embodiment of the cathode ray tube device according to the invention, and FIG. 5 is a partially cut-away rear view seen in the P direction in FIG. 4. In FIGS. 4 and 5, the same reference numerals as those shown in FIGS. 1 to 3 represent the same functions as the above-mentioned ones. A cathode ray tube device 38 according to the invention, which is shown in FIGS. 4 and 5, includes three sections, i.e., a cathode ray tube 33, the lens assembly 15 and the coupler 26, and these three sections are integrally assembled by a fixing member SA.

The cathode ray tube 33 has a plurality of projecting positioning portions 30 on the outside peripheral surface of the panel portion 20, and these positioning portions 30 are disposed, two (30*a* and 30*b*) on a longer side of the panel portion 20 and one (30*c*) on a shorter side of the same. The positioning portions 30 are used as marks for mutual positioning when the panel portion 20 is to be coupled to the coupler 26 by using an assembling jig (not shown).

These positioning portions 30 may have, in addition to the projecting forms, any other forms that serve as marks, for example, concave forms.

In the construction of the cathode ray tube device 38, bulb fixing plates BT which constitute part of the fixing member SA are held in engagement with the corresponding ones of the engaging projections 29 on the outside surface of the funnel portion 2, and the bulb fixing plates BT disposed on the rear side and coupler fixing plates CT disposed on the front side are held in engagement with screws SC which are symmetrically disposed with respect to the tube axis of the cathode ray tube 33, whereby the bulb fixing plates BT and the coupler fixing plates CT are tightened in the direction parallel with the tube axis of the cathode ray tube 33 to fix the coupler 26 and the cathode ray tube 33 to each other. Accordingly, the rotational displacement of the cathode ray tube 33 about the tube axis with respect to the coupler 26 can be prevented, and the three sections can be coupled together in a predetermined positional relationship.

The coupler 26 and the cathode ray tube 33 are fixed in the above-mentioned manner that the bulb fixing plates BT and the coupler fixing plates CT of the fixing member SA are tightened by the screws SC in the direction parallel to the tube axis of the cathode ray tube 33.

At this time, the outside surface 21*c* of the faceplate 21 has a convex form which is curved toward the electron gun, and the surface of the coupler 26 that is opposite to the faceplate 21 is inclined along the outside surface 21*c* of the faceplate 21, whereby the tube axis of the cathode ray tube 33 and the central axis of the coupler 26 can be made coincident with each other by pressing the coupler 26 and the faceplate 21 against each other in the direction parallel to the tube axis.

The outside surface 21*c* of the faceplate 21 is formed to have a single radius of curvature, and the surface of the coupler 26 that is held in contact with the faceplate 21 is formed to have the same curvature as that of the outside surface 21*c* of the faceplate 21. The coupler 26 is fixed by being pressed against the faceplate 21 by the fixing member SA which has the bulb fixing plates BT, the coupler fixing plates CT and the screws SC. The screws SC of the fixing member SA are symmetrically disposed with respect to the tube axis of the cathode ray tube 33, and tighten the bulb fixing plates BT and the coupler fixing plates CT in the direction parallel to the tube axis of the cathode ray tube 33.

In the above-described embodiment of the cathode ray tube device according to the invention, the deviation between the tube axis of the cathode ray tube 33 and the central axis of the coupler 26 can be restrained to easily make the tube axis of the cathode ray tube 33 coincident with the central axis of the coupler 26.

The lens assembly 15 includes a plurality of lenses 15*b* to 15*e* disposed in a lens barrel 15*f* rearwardly from the lens 15*a* which is in contact with the refrigerant liquid 17.

In FIG. 4, the top portion of the cathode ray tube device 38 taken along the central axis thereof in which the tube axis of the cathode ray tube 33, the central axis of the coupler 26 and the central axis of the lens assembly 15 coincide with one another is shown in cross-sectional view, while the bottom portion of the cathode ray tube device 38 taken along the central axis thereof is shown in external side view.

In the construction of the above-described embodiment, the deviation between the tube axis of the cathode ray tube 33 and the central axis of the coupler 26 can be restrained to easily make the tube axis of the cathode ray tube 33 coincident with the central axis of the coupler 26, and it is possible to remarkably increase the effect of preventing the rotational deviation of the cathode ray tube 33 about the tube axis with respect to the coupler 26.

Figure 6:
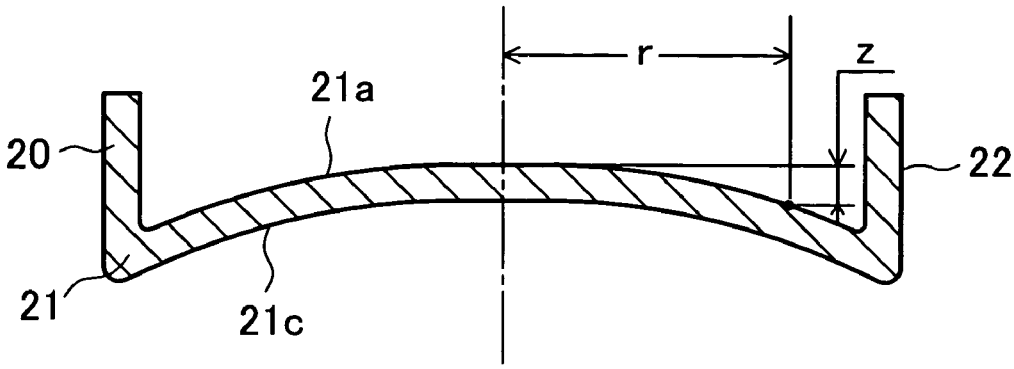
FIG. 6 is a schematic cross-sectional view showing the essential portion of yet another embodiment of the cathode ray tube device according to the invention.

FIG. 6 is a schematic cross-sectional view showing the essential portion of yet another embodiment of the cathode ray tube device according to the invention, and in FIG. 6, the same reference numerals as those shown in FIGS. 1 to 5 represent the same functions as the above-mentioned ones. In the cathode ray tube device shown in FIG. 6, the inside surface 21*a* of the faceplate 21 is formed to have an aspherical form expressed by Equation (1), while the outside surface 21*c* is formed to have a simple spherical surface. In FIG. 6, r denotes the distance from the central axis, and z represents the amount of depression.

$$Z = \frac{r^2/R}{1+\sqrt{1-(1+K9r^2/R^2}} + AD\cdot r^4 + AE\cdot r^6 + AF\cdot r^8 + AG\cdot r^{10}, \quad (1)$$

where R=−500,

K=0,

AD=$-1.23286\times10^{-6}$,

AE=$5.93925\times10^{-10}$,

AF=$-9.7263\times10^{-14}$, and

AG=$4.6157\times10^{-18}$.

In addition, in this embodiment, the curvature of the outside surface 21*c* is smaller than the average curvature of the inside surface 21*a*.

Figure 7:
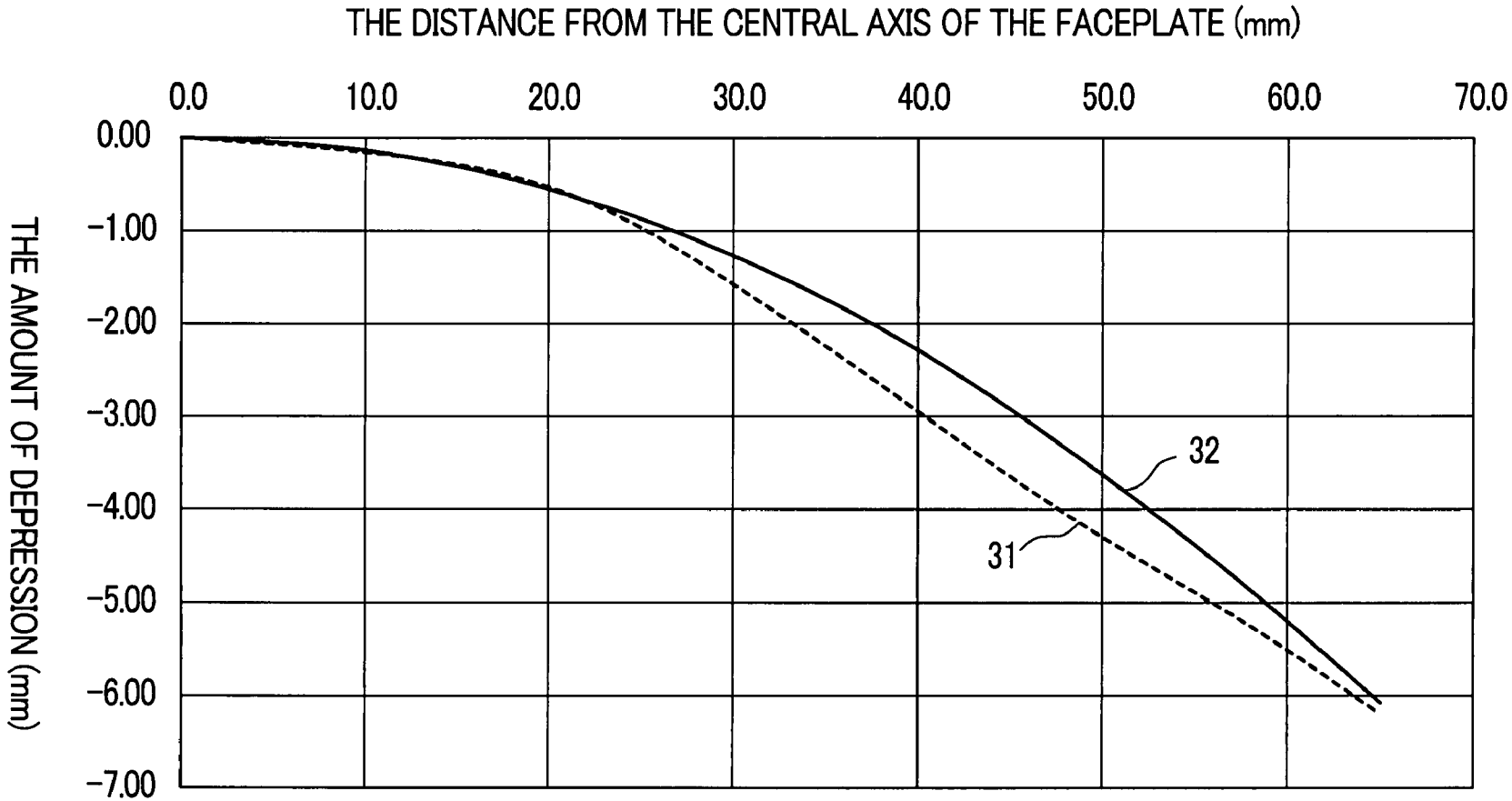
FIG. 7 is a view showing the distance from the central axis of a faceplate and the amount of depression thereof.

In a specific example of this embodiment, each of the radii of curvature Rc and Rf is set to 340 mm and the faceplate thickness is set to 10 mm, and the inside surface 21*a* is formed as a curved surface along the curved line shown by a dotted line 31 in FIG. 7 showing the distance from the center of a faceplate 21 and the amount of depression thereof.

In FIG. 7, a solid line 32 shows the form of the inside surface 21*a* of the first embodiment of the invention shown in FIG. 1. In the construction of the embodiment shown in FIG. 6, the focus performance can be improved to a further extent.

Figure 8:
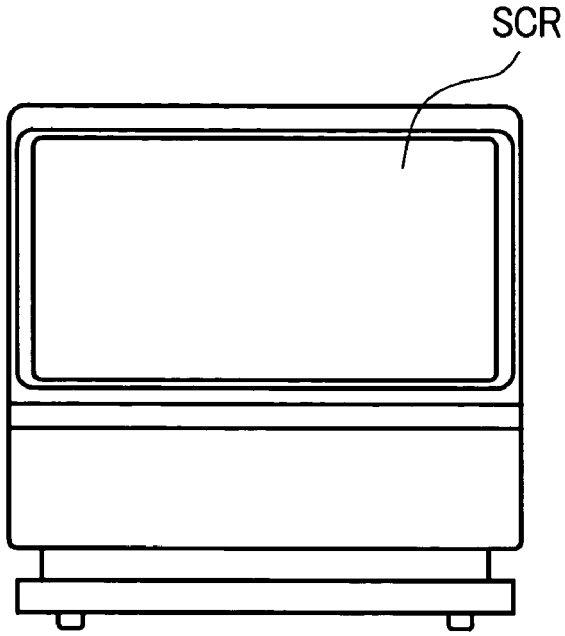
FIG. 8 is a schematic front view of a rear projection television which is one example of a projection image display apparatus using a projection cathode ray tube device.
Figure 9:
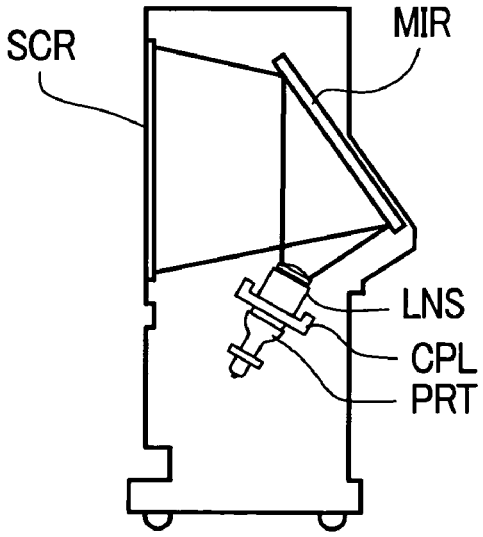
FIG. 9 is a schematic cross-sectional side view of the rear projection television shown in FIG. 8.

FIG. 8 is a schematic front view of a rear projection television which is one example of a projection type of image display apparatus using a projection cathode ray tube device, and FIG. 9 is a schematic cross-sectional side view of the rear projection television shown in FIG. 8. As shown in FIGS. 8 and 9, a projection lens assembly LNS is secured via a coupler CPL to a panel of a projection cathode ray tube PRT disposed in a lower portion of the projection television set, and an image formed on the panel of the cathode ray tube PRT is enlarged by the projection lens assembly LNS and projected onto a screen SCR disposed on the front side, by a mirror MIR disposed on the rear side.

According to the projection television having the above-mentioned construction, it is possible to substantially reduce the projection distance from the projection cathode ray tube PRT to the screen SCR, whereby it is possible to construct an image reproducing apparatus which has a thin depth and is compact.

Owing to an improvement in focus performance due to the use of a cathode ray tube device according to the invention in this projection television, it is possible to provide a high-definition and high-quality image display apparatus.

Figure 10:
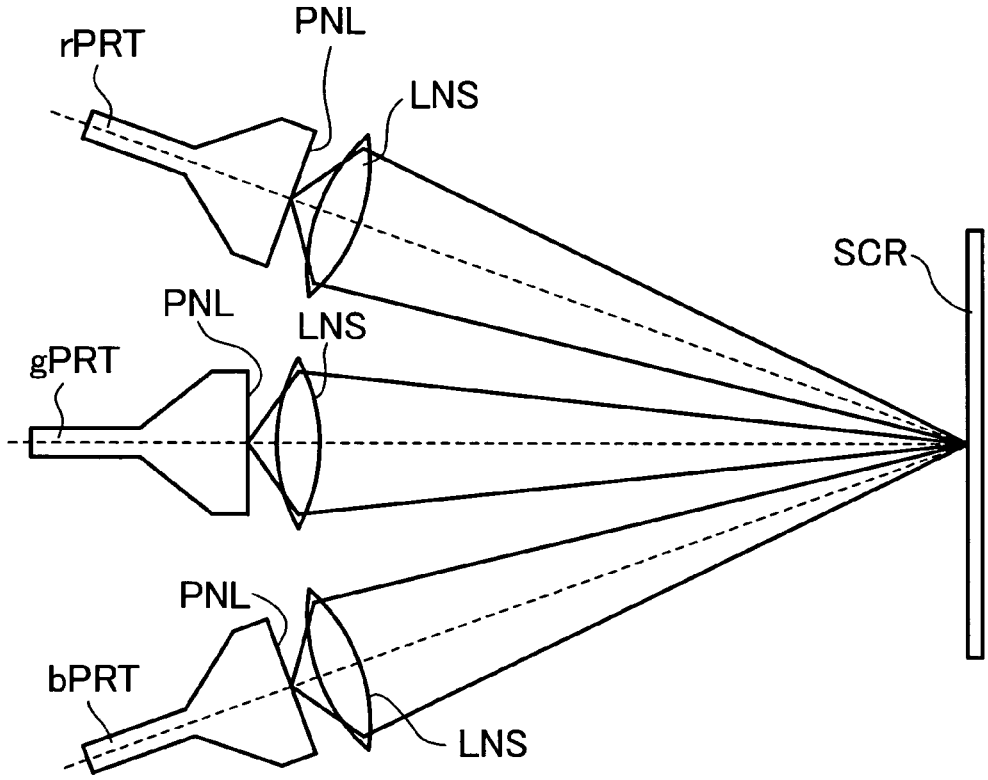
FIG. 10 is a schematic view aiding in describing one example of an image reproducing method for a projection image display apparatus using the projection cathode ray tube device.
Figure 11:
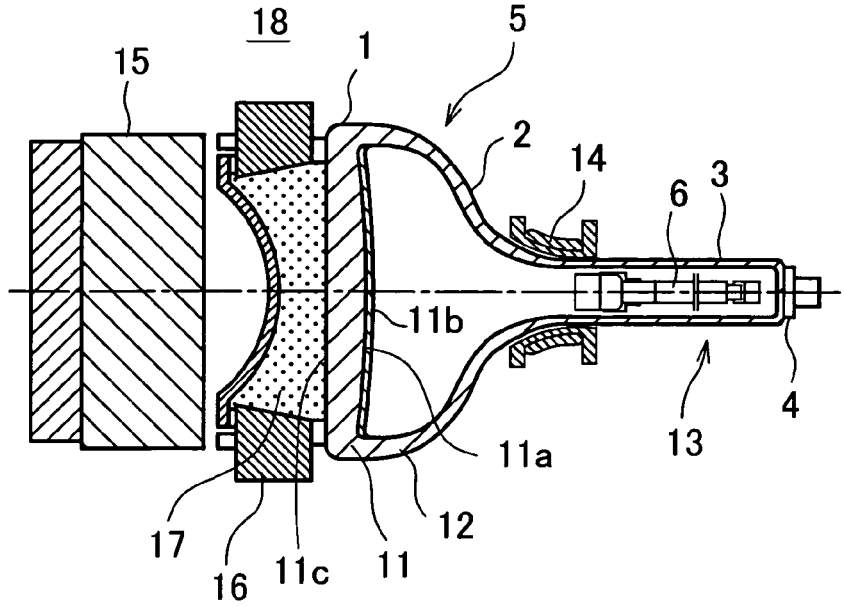
FIG. 11 is a schematic cross-sectional view aiding in describing an example of a structure of a related-art projection cathode ray tube device.

FIG. 10 is a schematic view aiding in describing one example of an image reproducing method for a projection image display apparatus using the above-mentioned projection cathode ray tube device. In FIG. 10, rPRT, gPRT and bPRT respectively denote red, green and blue projection cathode ray tubes, PNL denote panels which are image forming portions of the respective projection cathode ray tubes, LNS denote projection lens assemblies, and SCR denotes a projection screen.

As shown in FIG. 10, the projection screen SCR is disposed approximately vertically on the central axis of the green projection cathode ray tube gPRT at a position which is opposite to the panel PNL and is spaced apart therefrom by a predetermined distance. The other red and blue projection cathode ray tubes rPRT and bPRT are respectively disposed on the left and right sides of the green projection cathode ray tube gPRT as viewed in FIG. 10 in the same plane as the green projection cathode ray tube gPRT, and are respectively fixed at angles which make their central axes coincide with the central axis of the central green projection cathode ray tube gPRT on the projection screen SCR.

The projection lens assemblies LNS are respectively disposed in front of the panels of the projection cathode ray tubes rPRT, gPRT and bPRT on the same axes as the axes of the corresponding ones of the projection cathode ray tubes rPRT, gPRT and bPRT, and project monochromatic images formed on the respective panels onto the screen SCR on an enlarged scale to superpose the projected images on one another, thereby forming a color image.

According to this projection image display apparatus which uses the projection cathode ray tube devices according to the invention, it is possible to provide a high-definition and high-quality projection type of image display apparatus.

As described hereinabove, according to the invention, the inside and outside surfaces of the faceplate of the panel portion of a projection cathode ray tube are respectively formed to have spherical forms, and the convex surface of the faceplate is curved toward an electron gun, and the curvature of the outside surface is made smaller than the curvature of the inside surface, whereby the coaxial arrangement of a phosphor screen and a projection lens assembly is ensured and focus performance is improved. Accordingly, it is possible to provide a high-definition and high-quality cathode ray tube device. In addition, it is possible to provide a high-definition and high-quality image display apparatus which includes the cathode ray tube according to the invention and is superior in focus performance.

What is claimed is:

1. A cathode ray tube device comprising:

a cathode ray tube including a panel portion having an image-displaying phosphor screen on an inside surface of a faceplate, a neck portion containing an electron gun to emit an electron beam toward the phosphor screen, a funnel portion connecting the panel portion and the neck portion, and a stem portion closing an open end of the neck portion;

a deflector containing a deflection yoke fitted on the cathode ray tube;

a lens assembly disposed on the side of an outside surface of the faceplate;

a coupler disposed between the lens assembly and the cathode ray tube to couple both of them to each other, and provided with a flange portion facing the outside surface of the faceplate; and a refrigerant liquid disposed in a space surrounded by the lens assembly, the coupler and the outside surface of the faceplate, wherein approximately the whole region of each of the inside and outside surfaces of the faceplate is a convex surface curved toward the electron gun and an outside-surface curvature of the faceplate is smaller than an inside-surface curvature of the faceplate, the flange portion of the coupler having a convex surface curved toward the electron gun.

2. A cathode ray tube device according to claim 1, wherein the center of curvature of each of the inside and outside surfaces of the faceplate is located at the same point on a side where the lens assembly is disposed.

3. A cathode ray tube device according to claim 1, wherein the faceplate has a uniform thickness in approximately all regions.

4. A cathode ray tube device according to claim 1, wherein the inside surface of the faceplate is aspherical.

5. A cathode ray tube device according to claim 1, wherein the convex surface of the flange portion of the coupler is approximately the same in curvature as the outside surface of the faceplate.

6. A cathode ray tube device according to claim 1, wherein a lens surface of the lens assembly that is in contact with the refrigerant liquid is a convex surface curved toward the electron gun.

7. A cathode ray tube device comprising:

a cathode ray tube including a panel portion having an image-displaying phosphor screen on an inside surface of a faceplate, a neck portion containing an electron gun to emit an electron beam toward the phosphor screen, a funnel portion connecting the panel portion and the neck portion, and a stem portion closing an open end of the neck portion;

a lens assembly disposed on the side of an outside surface of the faceplate; and a coupler disposed between the lens assembly and the faceplate of the cathode ray tube, wherein the outside surface of the faceplate is a convex surface curved toward the electron gun, the coupler provided with a flange portion facing the outside surface of the faceplate, the flange portion of the coupler having a convex surface curved toward the electron gun, the convex surface of the flange portion is inclined along the opposite outside surface of the faceplate, and the coupler is fixed by being pressed against the faceplate.

8. A cathode ray tube device according to claim 7, wherein the outside surface of the faceplate has a single radius of curvature.

9. A cathode ray tube device according to claim 7, wherein a fixing member which fixes the coupler to the faceplate by pressing the coupler against the faceplate includes a plurality of screws symmetrically disposed with respect to a tube axis of the cathode ray tube and a plurality of fixing plates coupled to the screws, and generates tightening forces in a direction parallel to the tube axis when the screws are tightened.

* * * * *